US011826767B2

(12) United States Patent
Seto et al.

(10) Patent No.: US 11,826,767 B2
(45) Date of Patent: Nov. 28, 2023

(54) LIQUID EJECTION DEVICE

(71) Applicant: SEIKO EPSON CORPORATION, Tokyo (JP)

(72) Inventors: Takeshi Seto, Tokyo (JP); Hirokazu Sekino, Nagano (JP); Hideki Kojima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 68 days.

(21) Appl. No.: 17/200,961

(22) Filed: Mar. 15, 2021

(65) Prior Publication Data

US 2021/0283635 A1 Sep. 16, 2021

(30) Foreign Application Priority Data

Mar. 16, 2020 (JP) ..... 2020-045030

(51) Int. Cl.
*B05B 12/06* (2006.01)
*B05B 1/08* (2006.01)

(52) U.S. Cl.
CPC ..... *B05B 12/06* (2013.01); *B05B 1/086* (2013.01)

(58) Field of Classification Search
CPC ..... A61B 17/3203; A61B 17/2037; A61B 17/2032; A61B 17/2035; B05B 1/086; B05B 12/06; B05B 1/08; B05B 17/0607; B05B 17/0653
See application file for complete search history.

(56) References Cited

U.S. PATENT DOCUMENTS

| | | | | |
|---|---|---|---|---|
| 9,737,327 | B2 * | 8/2017 | Kojima ..... | A61B 17/3203 |
| 2010/0111708 | A1 | 5/2010 | Seto et al. | |
| 2011/0037795 | A1 | 2/2011 | Kojima et al. | |
| 2015/0224527 | A1 | 8/2015 | Kojima et al. | |
| 2015/0238215 | A1 | 8/2015 | Kojima et al. | |
| 2017/0196441 | A1 | 7/2017 | Kojima et al. | |

FOREIGN PATENT DOCUMENTS

| | | | |
|---|---|---|---|
| CN | 106488749 | A | 3/2017 |
| JP | H09-285744 | A | 11/1997 |
| JP | 2007-160716 | A | 6/2007 |
| JP | 2010-106748 | A | 5/2010 |
| JP | 2011-036533 | A | 2/2011 |
| JP | 2012-047071 | A | 3/2012 |

* cited by examiner

*Primary Examiner* — Christopher R Dandridge
(74) *Attorney, Agent, or Firm* — Global IP Counselors, LLP

(57) ABSTRACT

A liquid ejection device includes: a nozzle through which a liquid is ejected; a liquid transporting pipe coupling to the nozzle; a pulsation generator configured to change a volume of a liquid chamber coupling to the liquid transporting pipe; a pump configured to send a liquid to the liquid transporting pipe; and a control unit configured to control driving of the pulsation generator and the pump. The control unit drives the pulsation generator and the pump such that Vf/Q is 0.3 or more, in which V [$mm^3$] is a volume change amount of the liquid chamber, Q [mL/min] is a flow rate of a liquid to the liquid transporting pipe by the pump, and f [kHz] is a frequency at which the pulsation generator applies a pulsation to a liquid.

2 Claims, 7 Drawing Sheets

LIQUID EJECTION DEVICE

The present application is based on, and claims priority from JP Application Serial Number 2020-045030, filed Mar. 16, 2020, the disclosure of which is hereby incorporated by reference herein in its entirety.

BACKGROUND

1. Technical Field

The present disclosure relates to a liquid ejection device.

2. Related Art

In related art, various liquid ejection devices for ejecting a liquid onto an object have been used. Among such liquid ejection devices, there is a liquid ejection device aiming at ejecting a liquid to an object in a state where the liquid has a large amount of energy. For example, JP-A-9-285744 discloses a surface processing device that mixes and ejects a liquefied gas and a high-pressure liquid.

However, the surface processing device disclosed in JP-A-9-285744 has problems such as a need for controlling a temperature of the liquefied gas and an increase in size of equipment required for storing the liquefied gas, which lead to low workability. As the liquid ejection device for ejecting a liquid onto an object, there is a liquid ejection device having a configuration in which a liquid is continuously ejected, the injected liquid in a continuous state is dropletized, and the dropletized liquid is ejected onto an object. The liquid ejection device having such a configuration has advantages that material management is simple and size of the device is easily reduced. However, in the liquid ejection device having such a configuration, a preferable interval from an ejecting unit to the object may be long. In the liquid ejection device having such a configuration, it is preferable that the object is located at a droplet formation position where the ejected liquid in a continuous state forms a droplet, this is because the droplet formation position may be a position away from the ejecting unit depending on liquid ejection conditions and the like. When the interval from the ejecting unit to the object becomes long, the workability deteriorates, for example, a wide work space is required to be secured.

SUMMARY

A liquid ejection device according to the present disclosure includes: a nozzle through which a liquid is ejected; a liquid transporting pipe coupling to the nozzle; a pulsation generator configured to change a volume of a liquid chamber coupling to the liquid transporting pipe; a pump configured to send a liquid to the liquid transporting pipe; and a control unit configured to control driving of the pulsation generator and the pump. The control unit drives the pulsation generator and the pump such that Vf/Q is 0.3 or more, in which V [$mm^3$] is a volume change amount of the liquid chamber, Q [mL/min] is a flow rate of a liquid to the liquid transporting pipe by the pump, and f [kHz] is a frequency at which the pulsation generator applies a pulsation to a liquid.

DESCRIPTION OF EXEMPLARY EMBODIMENTS

First, the present disclosure will be briefly described.

A liquid ejection device according to a first aspect of the present disclosure includes: a nozzle through which a liquid is ejected; a liquid transporting pipe coupling to the nozzle; a pulsation generator configured to change a volume of a liquid chamber coupling to the liquid transporting pipe; a pump configured to send a liquid to the liquid transporting pipe; and a control unit configured to control driving of the pulsation generator and the pump. When a volume change amount of the liquid chamber is set to V [$mm^3$], a flow rate of a liquid to the liquid transporting pipe by the pump is set to Q [mL/min], and a frequency at which the pulsation generator applies a pulsation to a liquid is set to f [kHz], the control unit drives the pulsation generator and the pump to set Vf/Q to 0.3 or more.

According to the present aspect, the pulsation generator and the pump are driven, so that the Vf/Q becomes 0.3 or more. By driving the pulsation generator and the pump under such a condition, the liquid in a continuous state can be dropletized in a preferable state, and meanwhile, a standoff distance from the nozzle to a droplet formation position can be as short as 20 mm or less. Therefore, workability of the liquid ejection device is improved.

The liquid ejection device according to a second aspect of the present disclosure is directed to the first aspect, the control unit drives the pulsation generator to set the f to 5 [kHz] or more and less than 15 [kHz].

According to the present aspect, the pulsation generator can be driven to set the f to 5 [kHz] or more and less than 15 [kHz]. By driving the pulsation generator under such a condition, variation in data can be prevented from becoming large and reliability can be prevented from being impaired.

The liquid ejection device according to a third aspect of the present disclosure is directed to the first aspect, the pulsation generator includes a flexible wall portion forming at least a part of the liquid chamber, and a piezoelectric element configured to apply a force to the wall portion.

According to the present aspect, it is possible to form a mechanism in which a pulsation is applied to the liquid at a high frequency by the flexible wall portion that forms at least a part of the liquid chamber and the piezoelectric element that applies a force to the wall portion.

The liquid ejection device according to a fourth aspect of the present disclosure is directed to the first aspect, the pulsation generator includes a wall portion forming at least a part of the liquid chamber, and a heat generation element.

According to the present aspect, it is possible to form a mechanism easily in which a pulsation is applied to the liquid by the wall portion that forms at least a part of the liquid chamber and the heat generation element.

Hereinafter, embodiments of the present disclosure will be described with reference to accompanying drawings.

First Embodiment

Figure 1:
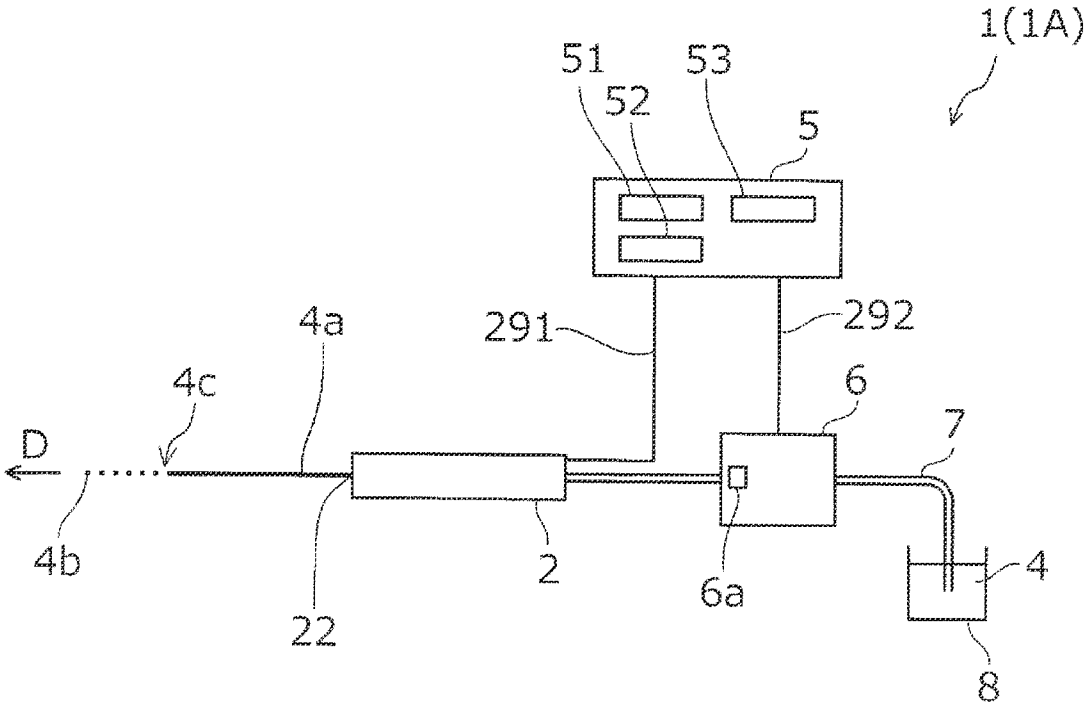
FIG. 1 is a schematic view showing a liquid ejection device according to a first embodiment.

First, a liquid ejection device 1A according to a first embodiment as a liquid ejection device 1 according to the present disclosure will be described with reference to FIG. 1. The liquid ejection device 1A shown in FIG. 1 includes an ejecting unit 2, a liquid container 8 for storing a liquid 4, a liquid supply pipe 7 coupling the ejecting unit 2 and the liquid container 8, a pump 6, and a control unit 5. The liquid ejection device 1A performs various kinds of work by ejecting the liquid 4 from the ejecting unit 2 to cause the liquid 4 to collide with an object. Examples of the various kinds of work include cleaning, deburring, peeling, trimming, excising, incising, and crushing. Hereinafter, each unit of the liquid ejection device 1A will be described in detail with reference to FIGS. 1 and 2.

Ejecting Unit

Figure 2:
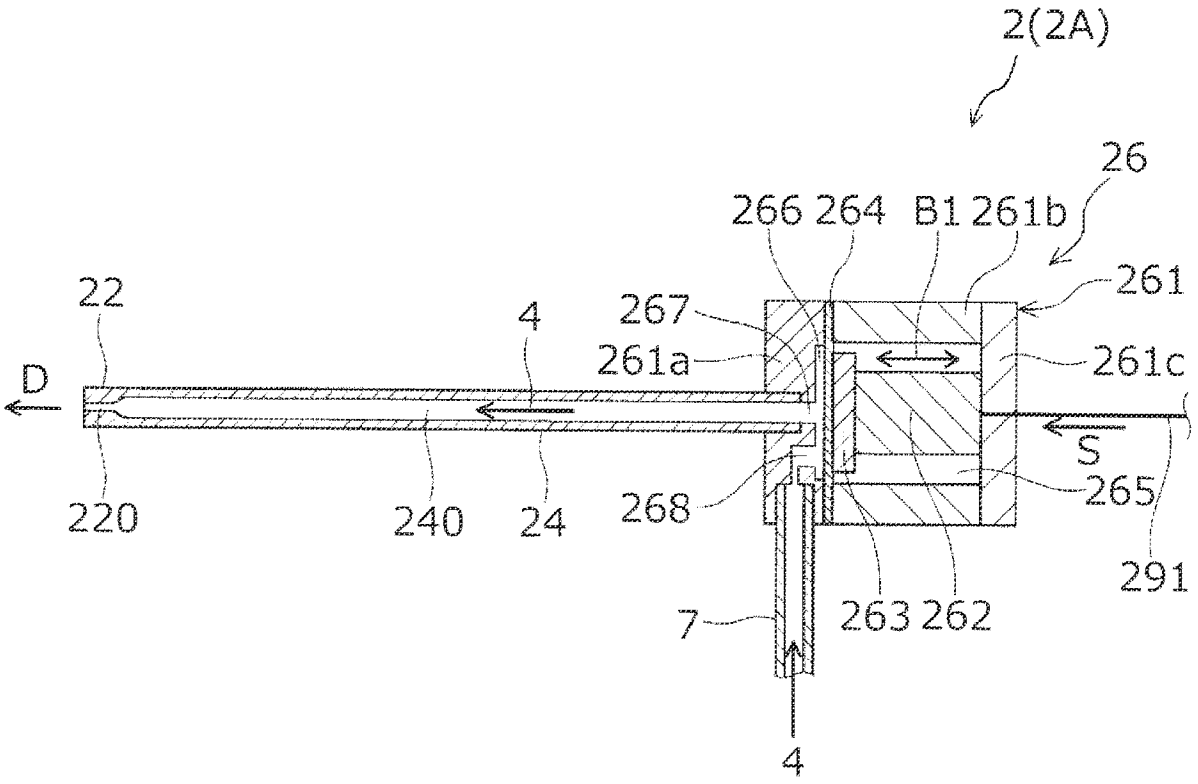
FIG. 2 is a cross-sectional view showing an ejecting unit of the liquid ejection device according to the first embodiment.

As shown in FIG. 2, an ejecting unit 2A, which is the ejecting unit 2 of the liquid ejection device 1A, includes a nozzle 22, a liquid transporting pipe 24, and a pulsation generator 26. Among these components, the nozzle 22 ejects the liquid 4 toward the object. The liquid transporting pipe 24 is a flow path that couples the nozzle 22 and the pulsation generator 26. The liquid transporting pipe 24 transports the liquid 4 from the pulsation generator 26 to the nozzle 22. Further, the pulsation generator 26 applies a flow rate pulsation to the liquid 4 supplied from the liquid container 8 via the liquid supply pipe 7. By applying the pulsation to the liquid 4 in this way, a flow speed of the liquid 4 ejected from the nozzle 22 fluctuates periodically. Accordingly, a distance until a liquid 4*a* in a continuous state ejected from the nozzle 22 changes to liquid droplets 4*b*, that is, a droplet formation distance can be shortened. That is, the ejecting unit 2A according to the present embodiment is configured to be capable of changing a distance from the nozzle 22 to a droplet formation position 4*c*. The droplet formation position 4*c* is a position where an impact pressure applied to an injection target by the liquid 4 ejected from the nozzle 22 is the maximum.

Hereinafter, each unit of the ejecting unit 2A will be described in detail. The nozzle 22 is mounted on to a tip end portion of the liquid transporting pipe 24. The nozzle 22 is internally provided with a nozzle flow path 220 through which the liquid 4 passes. A cross-sectional area of a tip end portion of the nozzle flow path 220 is smaller than a cross-sectional area of a base end portion of the nozzle flow path 220. The liquid 4 transported towards the nozzle 22 in the liquid transporting pipe 24 is formed into a trickle shape via the nozzle flow path 220, and is ejected. The nozzle 22 may be a member separate from the liquid transporting pipe 24, or may be integral with the liquid transporting pipe 24.

The liquid transporting pipe 24 is a pipe that couples the nozzle 22 and the pulsation generator 26, and includes a liquid flow path 240 that transports the liquid 4 in the liquid transporting pipe 24. The above nozzle flow path 220 communicates with the liquid supply pipe 7 through the liquid flow path 240. The liquid supply pipe 7 may be a straight pipe, or may be a curved pipe in which a part of or an entire pipe is curved.

The nozzle 22 and the liquid transporting pipe 24 may have rigidity of an extent that the nozzle 22 and the liquid transporting pipe 24 do not deform when the liquid 4 is ejected. Examples of a constituent material for the nozzle 22 include a metal material, a ceramic material, and a resin material. Examples of a constituent material for the liquid transporting pipe 24 include a metal material and a resin material, and in particular, the metal material is preferably used.

The cross-sectional area of the nozzle flow path 220 is appropriately selected according to work content, a material for the object, and the like. As an example, when a cross section of the nozzle flow path 220 is circular, an inner diameter of the cross section is preferably 0.01 mm or more and 1.00 mm or less, and more preferably 0.02 mm or more and 0.30 mm or less. Further, the cross-sectional area when the cross section of the nozzle flow path 220 is not circular may correspond to the cross-sectional area when the cross section is circular with the inner diameter of the cross section being in the preferable range and in the more preferable range.

The pulsation generator 26 includes a housing 261, a piezoelectric element 262 and a reinforcing plate 263 which are provided in the housing 261, and a diaphragm 264. The housing 261 has a box shape, and includes each part of a first case 261*a*, a second case 261*b*, and a third case 261*c*. Each of the first case 261*a* and the second case 261*b* has a cylindrical shape including a through hole penetrating from a base end to a tip end. The diaphragm 264 is interposed between an opening on a base end side of the first case 261*a* and an opening on a tip end side of the second case 261*b*. The diaphragm 264 is, for example, a film member having flexibility.

The third case 261*c* has a plate shape. The third case 261*c* is fixed to an opening on a base end side of the second case 261*b*. A space formed by the second case 261*b*, the third case 261*c*, and the diaphragm 264 is an accommodation chamber 265. The piezoelectric element 262 and the reinforcing plate 263 are accommodated in the accommodation chamber 265. A base end of the piezoelectric element 262 is coupled to the third case 261*c*, and a tip end of the piezoelectric element 262 is coupled to the diaphragm 264 via the reinforcing plate 263.

The through hole of the first case 261*a* penetrates from the base end to the tip end. Such a through hole includes a region on the base end side having a relatively large cross-sectional area of the through hole and a region on the tip end side having a relatively small cross-sectional area of the through hole. Among the regions, the liquid transporting pipe 24 is inserted into the region having the relatively small cross-sectional area of the through hole from the opening on the tip end side. In the region having the relatively large cross-sectional area of the through hole, the diaphragm 264 is in a covered state from the base end side. Then, a space formed by the region having the relatively large cross-sectional area of the through hole and the diaphragm 264 is a liquid chamber 266.

Further, a space between the liquid chamber 266 and the liquid transporting pipe 24 is an outlet flow path 267. On the other hand, an inlet flow path 268 different from the outlet flow path 267 communicates with the liquid chamber 266. One end of the inlet flow path 268 communicates with the liquid chamber 266, and the liquid supply pipe 7 is inserted into the other end. Accordingly, an internal flow path of the liquid supply pipe 7 communicates with the inlet flow path 268, the liquid chamber 266, the outlet flow path 267, the liquid flow path 240, and the nozzle flow path 220. As a result, the liquid 4 supplied to the inlet flow path 268 via the liquid supply pipe 7 is ejected by sequentially passing through the liquid chamber 266, the outlet flow path 267, the liquid flow path 240, and the nozzle flow path 220.

A wiring 291 is drawn out from the piezoelectric element 262 via the housing 261. The piezoelectric element 262 is electrically coupled to the control unit 5 via the wiring 291. According to a drive signal S supplied from the control unit 5, the piezoelectric element 262 vibrates so as to repeatedly expand and contract along an X-axis, as indicated by an arrow B1 in FIG. 2, based on a reverse piezoelectric effect. When the piezoelectric element 262 expands, the diaphragm 264 is pushed toward a first case 261*a* side. Therefore, a volume of the liquid chamber 266 reduces, so that the liquid 4 in the liquid chamber 266 is accelerated in the outlet flow path 267. On the other hand, when the piezoelectric element 262 contracts, the diaphragm 264 is drawn toward a third case 261*c* side. Therefore, the volume of the liquid chamber 266 expands, so that the liquid 4 in the inlet flow path 268 is decelerated or flows backward.

The piezoelectric element 262 may be an element that performs stretching vibration, or may be an element that performs bending vibration. The piezoelectric element 262 includes, for example, a piezoelectric body and an electrode provided on the piezoelectric body. Examples of a constituent material for the piezoelectric body include piezoelectric ceramics such as lead zirconate titanate (PZT), barium titanate, lead titanate, potassium niobate, lithium niobate, lithium tantalate, sodium tungstate, zinc oxide, barium strontium titanate (BST), strontium bismuth tantalate (SBT), lead metaniobate, and lead scandium niobate.

The piezoelectric element 262 can be replaced with any element or mechanical element that can displace the diaphragm 264. Examples of such an element or a mechanical element include a magnetostrictive element, an electromagnetic actuator, and a combination of a motor and a cam. The housing 261 may have rigidity of an extent that the housing 261 does not deform when a pressure in the liquid chamber 266 increases or decreases.

The pulsation generator 26 shown in FIG. 2 is provided at a base end portion of the liquid transporting pipe 24, but a position of the pulsation generator 26 is not particularly limited. For example, the pulsation generator 26 may be provided in the middle of the liquid transporting pipe 24.

Liquid Container

The liquid container 8 stores the liquid 4. The liquid 4 stored in the liquid container 8 is supplied to the ejecting unit 2A via the liquid supply pipe 7. As the liquid 4, for example, water is preferably used, and an organic solvent may be used. Any solute may be dissolved in the water or the organic solvent, and any dispersoid may be dispersed in the water or the organic solvent. The liquid container 8 may be a sealed container or an opened container.

Pump

The pump 6 is provided in the middle or an end portion of the liquid supply pipe 7. The liquid 4 stored in the liquid container 8 is suctioned by the pump 6 and supplied to the ejecting unit 2A at a predetermined pressure. The control unit 5 is electrically coupled to the pump 6 via a wiring 292. The pump 6 has a function of changing a flow rate of the liquid 4 to be supplied based on a drive signal output from the control unit 5. A flow rate of the pump 6 is preferably, as an example, 1 [mL/min] or more and 100 [mL/min] or less, more preferably 2 [mL/min] or more and 50 [mL/min] or less. The pump 6 is provided with a measurement unit 6*a* that measures an actual flow rate.

The pump 6 may include a built-in non-return valve as necessary. By providing such a non-return valve, it is possible to prevent the liquid 4 from flowing back through the liquid supply pipe 7 caused by the pulsation applied to the liquid 4 in the pulsation generator 26. The non-return valve may be provided independently in the middle of the liquid supply pipe 7 or in the inlet flow path 268.

Control Unit

The control unit 5 is electrically coupled to the ejecting unit 2A via the wiring 291. The control unit 5 is electrically coupled to the pump 6 via the wiring 292. The control unit 5 shown in FIG. 1 includes a piezoelectric element control unit 51, a pump control unit 52, and a storage unit 53 that stores various data such as control programs for the ejecting unit 2A and the pump 6.

The piezoelectric element control unit 51 outputs the drive signal S to the piezoelectric element 262. Driving of the piezoelectric element 262 is controlled by the drive signal S. Accordingly, the diaphragm 264 can be displaced at, for example, a predetermined frequency and a predetermined displacement amount. The pump control unit 52 outputs the drive signal to the pump 6. Driving of the pump 6 is controlled by the drive signal. Accordingly, the liquid 4 can be supplied to the ejecting unit 2A at, for example, a predetermined pressure and a predetermined drive time. The control unit 5 can control the driving of the pump 6 and the driving of the piezoelectric element 262 in cooperation with each other.

Such a function of the control unit 5 is implemented by hardware such as an arithmetic unit, a memory, and an external interface. Among these hardware, examples of the arithmetic unit include a central processing unit (CPU), a digital signal processor (DSP), and an application specific integrated circuit (ASIC). Examples of the memory include a read only memory (ROM), a flash ROM, a random access memory (RAM), and a hard disk.

Specific Control Method Performed by Control Unit

Next, when the liquid ejection device 1A of the present embodiment is used, how the control unit controls the driving of the ejecting unit 2A and the pump 6 will be described with reference to FIGS. 1, 2, and 3 to 7.

Figure 3:
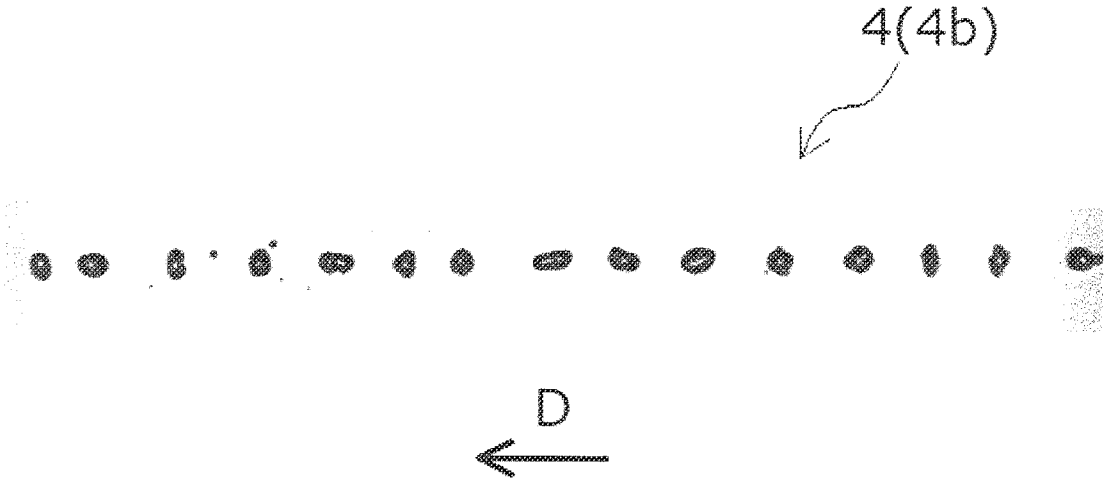
FIG. 3 is a photograph showing liquid droplets that are liquid ejected from the liquid ejection device according to the first embodiment, and are dropletized in a preferable state.

First, a preferable liquid droplet state of the liquid droplet 4*b* will be described with reference to FIGS. 3 to 5. As described above, in the liquid ejection device 1A of the present embodiment, the liquid 4*a* in the continuous state ejected from the nozzle 22 is changed into the liquid droplets 4*b* by the pulsation generator 26 applying a pulsation to the liquid 4. Here, FIG. 3 is a photograph showing the liquid droplets 4*b* dropletized in a preferable state. The pulsation generator 26 applies an appropriate pulsation to the liquid 4, so that the substantially spherical liquid droplets 4*b* can be formed at substantially constant intervals and have a substantially constant droplet size as shown in FIG. 3.

Figure 4:
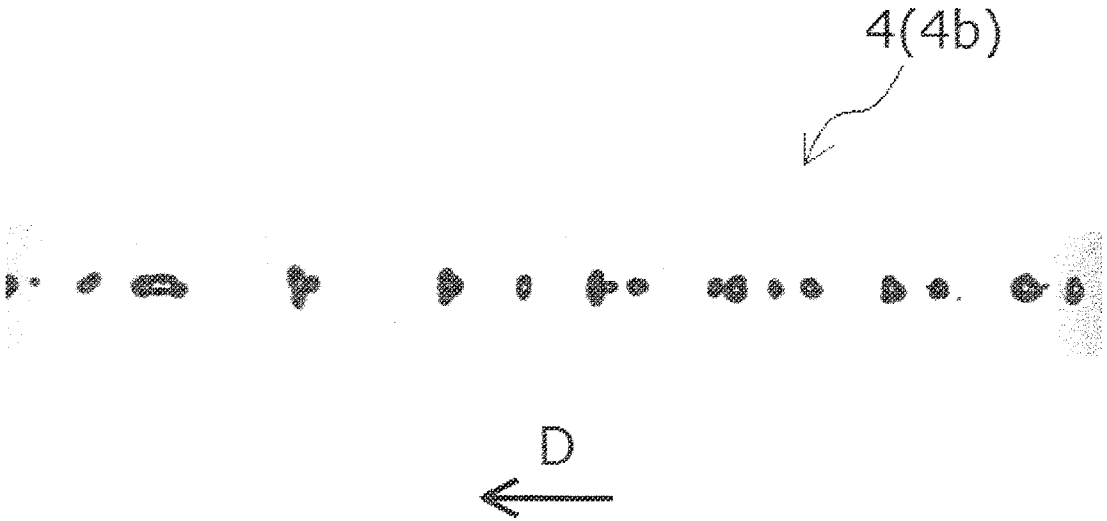
FIG. 4 is a photograph showing liquid droplets that are liquid ejected from the liquid ejection device according to the first embodiment, and are dropletized in a state with insufficient pulsation.
Figure 5:
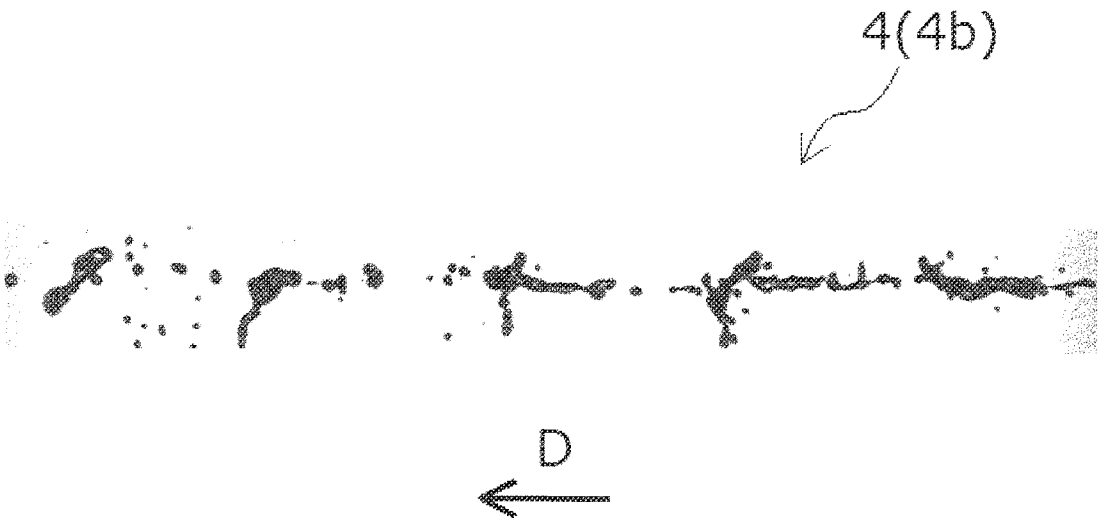
FIG. 5 is a photograph showing liquid droplets that are liquid ejected from the liquid ejection device according to the first embodiment, and are dropletized in a state with excessive pulsation.

On the other hand, FIG. 4 is a photograph showing the liquid droplets 4*b* that are dropletized in a state with insufficient pulsation, and FIG. 5 is a photograph showing the liquid droplets 4*b* that are dropletized in a state with excessive pulsation. As shown in FIGS. 4 and 5, the liquid droplets 4*b* that are dropletized in the state with insufficient pulsation or in the state with excessive pulsation do not have consistent intervals between the liquid droplets 4*b*, and meanwhile, the droplet size also varies widely, and the shape does not become spherical. The liquid droplets 4*b* as shown in FIG. 3 enable various works such as cleaning, deburring, peeling, trimming, excising, incising, and crushing to be performed efficiently, but the liquid droplets 4*b* as shown in FIGS. 4 and 5 may cause efficiency of the various works to be reduced.

Figure 6:
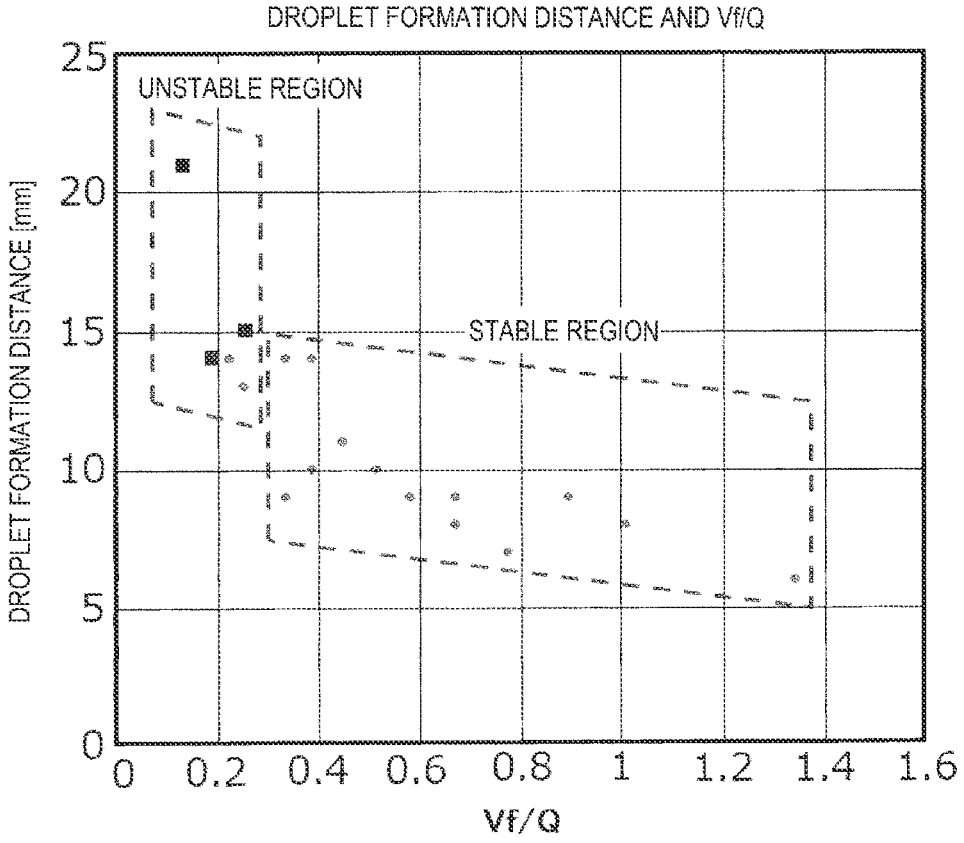
FIG. 6 is a graph showing a relationship between Vf/Q and a droplet formation distance.

Here, a volume change amount of the liquid chamber 266 is set to V [$mm^3$], a flow rate of the liquid 4 to the liquid transporting pipe 24 by the pump 6 is set to Q [mL/min], and a frequency at which the pulsation generator 26 applies a pulsation to the liquid 4 is set to f [kHz]. FIG. 6 shows a relationship between Vf/Q, which is a value obtained by dividing the volume change amount V by a liquid droplet volume Q/f, and the droplet formation distance. Further, in FIG. 6, a region where the liquid droplet is ejected in a stable state and a region where the liquid droplet is ejected in an unstable state are separated. In FIG. 6, experimental results obtained when a liquid droplet state is the preferable liquid droplet state as shown in FIG. 3 and a droplet formation distance is a preferable droplet formation distance of less than 20 mm are shown as round dots. In addition, experimental results obtained when the liquid droplet state is not the preferable liquid droplet state are shown as square dots. As the droplet formation distance decreases, the position where the impact pressure applied to the injection target by the liquid 4 ejected from the nozzle 22 is the maximum becomes closer, so that workability of the liquid ejection device is improved. A droplet formation distance when no pulsation is applied, when experimental conditions shown in FIG. 6 are met except for the application of the pulsation, is approximately 20 mm to 50 mm.

As shown in FIG. 6, by setting Vf/Q to 0.3 or higher, the droplet formation distance can be made in 20 mm or less, and obviously, the droplet formation distance can be shortened as compared with the case where no pulsation is applied. Further, as shown in FIG. 6, the liquid droplets can be prevented from being ejected in the unstable state.

As described above, the liquid ejection device 1A according to the present embodiment includes the ejecting unit 2A including the nozzle 22 through which the liquid 4 is ejected, the liquid transporting pipe 24 that transports the liquid 4 to the nozzle 22, and the pulsation generator 26 that applies a pulsation to the liquid 4 by changing the volume of the liquid chamber 266 that is coupled to the liquid transporting pipe 24. The liquid ejection device 1A further includes the pump 6 that sends the liquid 4 to the liquid transporting pipe 24, and the control unit 5 that controls the driving of the pulsation generator 26 and the pump 6. Then, under the control of the control unit 5, the pulsation generator 26 and the pump 6 are driven, so that the Vf/Q becomes 0.3 or more. By driving the pulsation generator 26 and the pump 6 to set the Vf/Q to 0.3 or more, the liquid 4*a* in the continuous state can be dropletized into the liquid droplet 4*b* in the preferable state as shown in FIG. 3, and meanwhile, the droplet formation distance as a standoff distance from the nozzle 22 to the droplet formation position 4*c* can be as short as 20 mm or less. Therefore, the workability of the liquid ejection device 1A of the present embodiment is improved.

Then, in the liquid ejection device 1A of the present embodiment, under the control of the control unit 5, the pulsation generator 26 can be driven to set the f to 5 [kHz] or more and less than 15 [kHz]. By driving the pulsation generator 26 under such a condition, variation in data can be prevented from becoming large and reliability can be prevented from being impaired.

Here, as described above, in the liquid ejection device 1A of the present embodiment, the pulsation generator 26 includes the diaphragm 264 as a flexible wall portion that forms at least a part of the liquid chamber 266, and the piezoelectric element 262 that applies a force to the diaphragm 264. Accordingly, the liquid ejection device 1A of the present embodiment forms a mechanism in which a pulsation is applied to the liquid 4 at a high frequency by the flexible diaphragm 264 that forms at least a part of the liquid chamber 266 and the piezoelectric element 262 that applies a force to the diaphragm 264. However, the present disclosure is not limited to this configuration. Hereinafter, an example of the liquid ejection device 1 having a configuration different from that of the liquid ejection device 1A of the present embodiment will be described.

Second Embodiment

Figure 7:
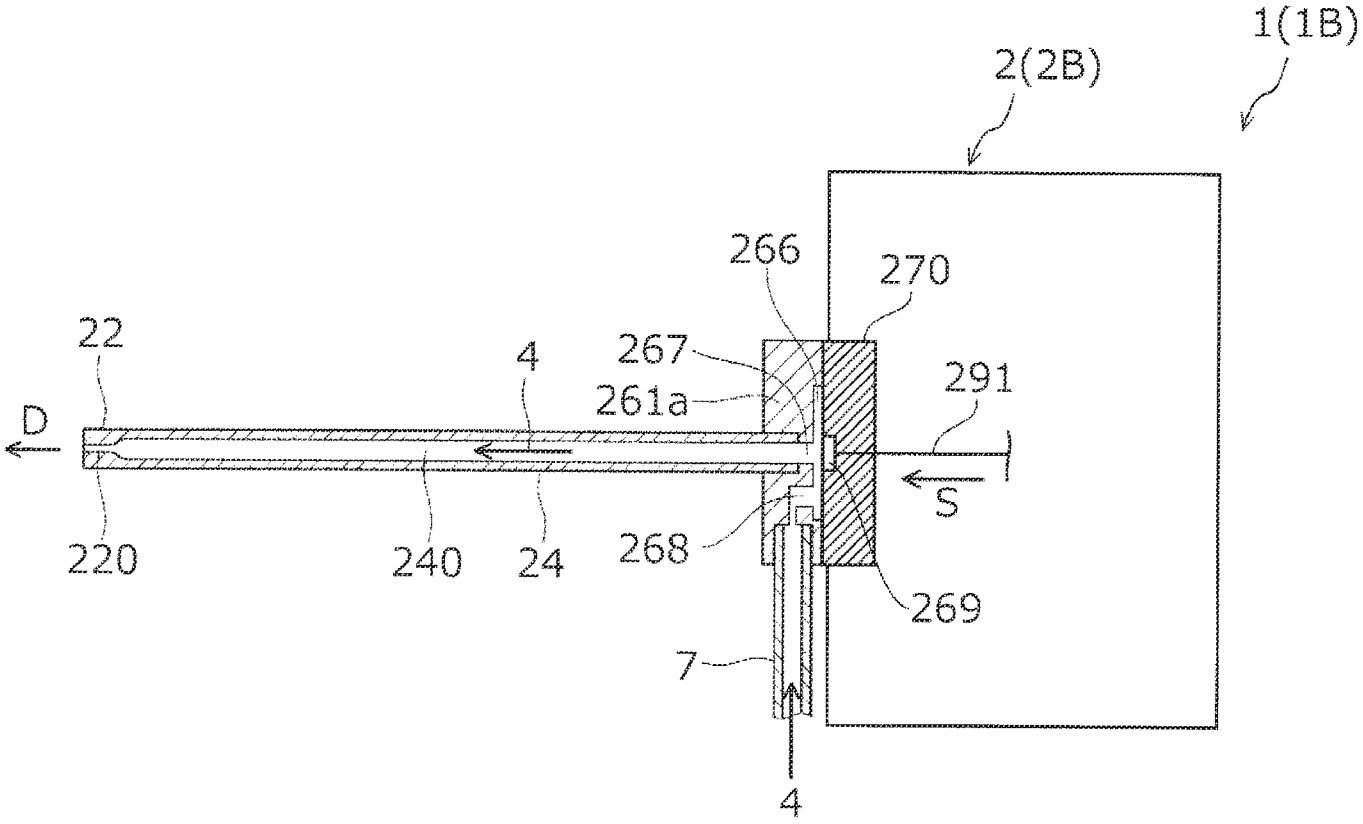
FIG. 7 is a cross-sectional view showing an ejecting unit of a liquid ejection device according to a second embodiment.

Hereinafter, a liquid ejection device 1B according to a second embodiment as the liquid ejection device 1 according to the present disclosure will be described with reference to FIG. 7. FIG. 7 is a view corresponding to FIG. 2 in the liquid ejection device 1 according to the first embodiment, and components common to those of the first embodiment are denoted by the same reference signs in FIG. 7, and a detailed description thereof is omitted. Here, the liquid ejection device 1B according to the present embodiment has similar characteristics as the liquid ejection device 1A according to the first embodiment described above, and has similar configuration as that of the liquid ejection device 1A according to the first embodiment except for the points described below. Specifically, a configuration of the liquid ejection device 1B is similar as that of the liquid ejection device 1A according to the first embodiment except for a configuration of the pulsation generator 26 in the ejecting unit 2.

As shown in FIG. 7, the liquid ejection device 1B according to the present embodiment includes an ejecting unit 2B, as the ejecting unit 2, that is capable of ejecting the liquid 4 by driving a heat generation element 269 to which the wiring 291 is coupled to generate a pulsation. Specifically, in the liquid ejection device 1B of the present embodiment, a pulsation generator 26 includes a wall portion 270 that forms at least a part of the liquid chamber 266, and the heat generation element 269. Then, under the control of the control unit 5, the heat generation element 269 is heated to foam the liquid 4, and a pulsation is applied to the liquid 4 due to a volume increase in the liquid 4. An amount of the volume increase due to this foaming corresponds to the volume change amount V. That is, the liquid ejection device 1B of the present embodiment forms a mechanism in which a pulsation is applied to the liquid 4 with such a simple configuration.

The present disclosure is not limited to the embodiments described above, and can be implemented in various configurations without departing from the scope of the disclosure. In order to solve some or all of problems described above, or to achieve some or all of effects described above, technical characteristics in the embodiments corresponding to the technical characteristics in each embodiment described in the summary of the disclosure can be replaced or combined as appropriate. The technical features can be deleted as appropriate unless the technical features are described as essential in the present specification.

What is claimed is:

1. A liquid ejection device comprising:

a nozzle through which a liquid is ejected;

a liquid transporting pipe coupling to the nozzle;

a pump configured to send the liquid to the liquid transporting pipe;

a pulsation generator arranged between the pump and the liquid transporting pipe, the pulsation generator having a wall forming at least a part of a liquid chamber that is fluidly connected to the liquid transporting pipe and a heat generator embedded flush within the wall, the pulsation generator being configured to cause a volume change of the liquid within the liquid chamber by foaming the liquid within the liquid chamber due to a heat generated by the heat generator; and a processor operatively coupled to the pump and the pulsation generator to control the pump and the pulsation generator, wherein the processor is configured to control the pump to change a flow rate of the liquid according to a volume change amount of the volume change of the liquid and a frequency at which the pulsation generator applies a pulsation to the liquid such that Vf/Q is 0.3 or more and the liquid ejected through the nozzle is dropletized into liquid droplets with a droplet formation distance from the nozzle to a droplet formation position is less than or equal to 20 mm, in which V [$mm^3$] is the volume change amount, Q [mL/min] is the flow rate of the liquid to the liquid transporting pipe by the pump, and f [kHz] is the frequency at which the pulsation generator applies the pulsation to the liquid and is 5 [kHz] or more.

2. The liquid ejection device according to claim 1, wherein f is 5 [kHz] or more and less than 15 [kHz].

* * * * *